US008172347B2

(12) United States Patent
Lim et al.

(10) Patent No.: US 8,172,347 B2
(45) Date of Patent: May 8, 2012

(54) VARIABLE SHELF ASSEMBLY AND REFRIGERATOR HAVING THE SAME

(75) Inventors: Jae Hoon Lim, Suwon-si (KR); Dae Yeop Park, Gwangju (KR); Myung Ju Sim, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 489 days.

(21) Appl. No.: 12/003,769

(22) Filed: Dec. 31, 2007

(65) Prior Publication Data

US 2008/0203041 A1 Aug. 28, 2008

(30) Foreign Application Priority Data

Feb. 26, 2007 (KR) ..... 10-2007-0019185

(51) Int. Cl.
*A47B 96/04* (2006.01)

(52) U.S. Cl. ..... 312/408; 312/306; 312/351; 312/319.6; 108/106; 108/147.17

(58) Field of Classification Search ..... 312/408, 312/126, 128, 404, 312, 410, 306, 350, 351, 312/247, 132, 319.5, 319.6, 319.7, 319.8; 108/106, 107, 108, 147, 147.11, 147.17, 108/20, 110; 211/187, 90.02, 208; 248/292.12, 248/244, 241, 295.11
See application file for complete search history.

(56) References Cited

U.S. PATENT DOCUMENTS

| | | | | | |
|---|---|---|---|---|---|
| 2,531,880 | A * | 11/1950 | Herring | 248/669 |
| 2,624,535 | A * | 1/1953 | Bollhoefer | 248/669 |
| 2,998,290 | A * | 8/1961 | Sharpe | 312/303 |
| 3,316,044 | A * | 4/1967 | Carbary | 312/408 |
| 3,982,801 | A * | 9/1976 | Heidorn et al. | 312/306 |
| 5,199,778 | A * | 4/1993 | Aoki et al. | 312/408 |
| 5,403,083 | A * | 4/1995 | Dasher et al. | 312/408 |
| 5,913,584 | A * | 6/1999 | Swindell et al. | 312/408 |
| 5,996,961 | A * | 12/1999 | Johnson | 248/669 |
| 6,065,821 | A * | 5/2000 | Anderson et al. | 312/408 |
| 7,178,890 | B2 * | 2/2007 | Park et al. | 312/408 |
| 7,306,303 | B2 * | 12/2007 | Ritchie et al. | 312/408 |
| 7,497,344 | B2 * | 3/2009 | Chen | 211/187 |
| 2006/0032264 | A1 * | 2/2006 | Shim | 62/408 |
| 2008/0115526 | A1 * | 5/2008 | Oh et al. | 62/465 |
| 2011/0168062 | A1 * | 7/2011 | Dellavecchia | 108/7 |

* cited by examiner

*Primary Examiner* — Darnell Jayne
*Assistant Examiner* — Daniel Rohrhoff
(74) *Attorney, Agent, or Firm* — Staas & Halsey LLP

(57) ABSTRACT

A variable shelf assembly includes a mounting member mounted in a storage compartment of a refrigerator, a shelf support member coupled to the mounting member such that the shelf support member is vertically movable, a shelf mounted on the shelf support member, and a lifting unit to lift the shelf support member. The mounting member and/or the shelf support member has a plurality of cool air circulation holes through which cool air circulating in the storage compartment passes. The lifting unit includes a driving gear, a driven gear rotatable by the driving gear, a screw shaft coupled to the driven gear, at least one moving member movable by the rotation of the screw shaft, and at least one rotary link having one end rotatably coupled to the moving member and the other end rotatably coupled to the mounting member.

14 Claims, 5 Drawing Sheets

VARIABLE SHELF ASSEMBLY AND REFRIGERATOR HAVING THE SAME

CROSS-REFERENCE TO RELATED APPLICATIONS

This application claims the benefit of Korean Patent Application No. 10-2007-0019185, filed on Feb. 26, 2007 in the Korean Intellectual Property Office, the disclosure of which is incorporated herein by reference.

BACKGROUND

1. Field

The present invention relates to a variable shelf assembly and a refrigerator having the same, and, more particularly, to a variable shelf assembly that is capable of changing the height of a shelf and a refrigerator having the same.

2. Description of the Related Art

Generally, a plurality of shelves are mounted in a storage compartment of a refrigerator. The shelves, which are vertically spaced apart from each other, partition the interior of the storage compartment into multi stages to increase the efficiency of the storage space utilization and accomplish easy receipt of food to be stored.

There has been proposed a refrigerator shelf that allows a user to change the height of the shelf if necessary. U.S. Pat. No. 5,913,584 discloses a variable shelf including a mounting member fixed to the rear of a storage compartment of a refrigerator, a shelf support member coupled to the mounting member such that the shelf support member is vertically movable, a shelf coupled to the shelf support member, and a lifting unit to lift the shelf support member.

The lifting unit includes a worm-type driving gear rotatable by the manipulation of a user, a driven gear rotatable by the driving gear, a gear shaft rotatable by the driven gear, two spur gears coupled to opposite ends of the gear shaft, and a gear box to rotatably support the driving gear and the gear shaft. The gear box is fixed to the shelf support member. The lifting unit further includes a gear bracket fixed to the mounting member and two rack gears mounted to opposite sides of the gear bracket such that the two rack gears are engaged with the two spur gears coupled to the opposite ends of the gear shaft. When the user rotates a rotary grip connected to the driving gear via an actuating rod, the two spur gears, coupled to the gear shaft, are rotated to lift the shelf support member.

However, this variable shelf of the refrigerator obstructs the circulation of cool air in the storage compartment because the mounting member and the shelf support member, adjacent to the rear of the storage compartment, cover a cool air circulation hole located at the rear of the storage compartment. This problem is further deepened when the position of the shelf support member is moved through the change in height of the shelf.

Furthermore, the structure of the lifting unit to lift the shelf support member is very complicated, and therefore, it is difficult to manufacture the variable shelf and the manufacturing costs of the variable shelf are high. Specifically, the lifting unit includes the two spur gears coupled to the opposite ends of the gear shaft, the two rack gears engaged with the two spur gears, and the gear bracket to support the two rack gears. Consequently, the number of parts of the lifting unit is large, and the structure of the lifting unit is complicated.

SUMMARY

Therefore, it is an aspect of the invention to provide a variable shelf assembly that accomplishes smooth circulation of cool air even when the height of a shelf is changed, and a refrigerator having the same.

It is another aspect of the invention to provide a variable shelf assembly wherein the structure of a lifting unit to lift a shelf support member is simplified, whereby the manufacture of the variable shelf assembly is easy and the manufacturing costs of the variable shelf assembly are reduced, and a refrigerator having the same.

Additional aspects and/or advantages will be set forth in part in the description which follows and, in part, will be apparent from the description, or may be learned by practice of the invention.

The foregoing and/or other aspects of the present invention are achieved by providing a variable shelf assembly including a mounting member mounted in a storage compartment of a refrigerator, a shelf support member coupled to the mounting member such that the shelf support member is vertically movable, a shelf mounted on the shelf support member, and a lifting unit to lift the shelf support member, wherein the mounting member and/or the shelf support member has a plurality of cool air circulation holes through which cool air circulating in the storage compartment passes.

The lifting unit includes a driving gear mounted to the shelf support member, a driven gear rotated by the driving gear, a screw shaft coupled to the driven gear and rotatably supported by the shelf support member, at least one moving member coupled to the screw shaft and movable by the rotation of the screw shaft, and at least one rotary link having a first end rotatably coupled to the moving member and a second end rotatably coupled to the mounting member.

Preferably, the screw shaft includes a left-handed screw part and a right-handed screw part disposed at opposite sides of the driven gear, the moving member includes first and second moving members mounted to the left-handed screw part and the right-handed screw part, respectively, and movable in opposite directions by the rotation of the screw shaft, and the rotary link includes a first rotary link having a first end rotatably coupled to the first moving member and a second end rotatably coupled to a first position of the mounting member and a second rotary link having a first end rotatably coupled to the second moving member and a second end rotatably coupled to a second position of the mounting member.

Preferably, the lifting unit further includes a rotary grip to rotate the driving gear and a connection rod to interconnect the rotary grip and the driving gear.

The foregoing and/or other aspects of the present invention are achieved by providing a variable shelf assembly including a mounting member mounted to an object to be supported, a shelf support member coupled to the mounting member such that the shelf support member is vertically movable, a shelf mounted on the shelf support member, and a lifting unit to lift the shelf support member, wherein the lifting unit includes a driving gear mounted to the shelf support member, a driven gear rotatable by the driving gear, a screw shaft coupled to the driven gear and rotatably supported by the shelf support member, at least one moving member coupled to the screw shaft and movable by the rotation of the screw shaft, and at least one rotary link having one end rotatably coupled to the moving member and the other end rotatably coupled to the mounting member.

In accordance with another aspect, the present invention provides a refrigerator including a main body having a storage compartment defined therein and a shelf assembly mounted in the storage compartment, wherein the shelf assembly includes a mounting member mounted in the storage compartment, a shelf support member coupled to the mounting member such that the shelf support member is vertically movable, a shelf mounted on the shelf support member, and a lifting unit to lift the shelf support member, and wherein the mounting member and/or the shelf support member has a plurality of cool air circulation holes through which cool air circulating in the storage compartment passes.

The foregoing and/or other aspects of the present invention are achieved by providing a refrigerator including a main body defining a storage compartment therein and a shelf assembly mounted in the storage compartment, wherein the shelf assembly includes a mounting member mounted in the storage compartment, a shelf support member coupled to the mounting member such that the shelf support member is vertically movable, a shelf mounted on the shelf support member, and a lifting unit to lift the shelf support member, and wherein the lifting unit includes a driving gear mounted to the shelf support member, a driven gear rotatable by the driving gear, a screw shaft coupled to the driven gear and rotatably supported by the shelf support member, at least one moving member coupled to the screw shaft and movable by the rotation of the screw shaft, and at least one rotary link having a first end rotatably coupled to the moving member and a second end rotatably coupled to the mounting member.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE EMBODIMENTS

Figure 1:
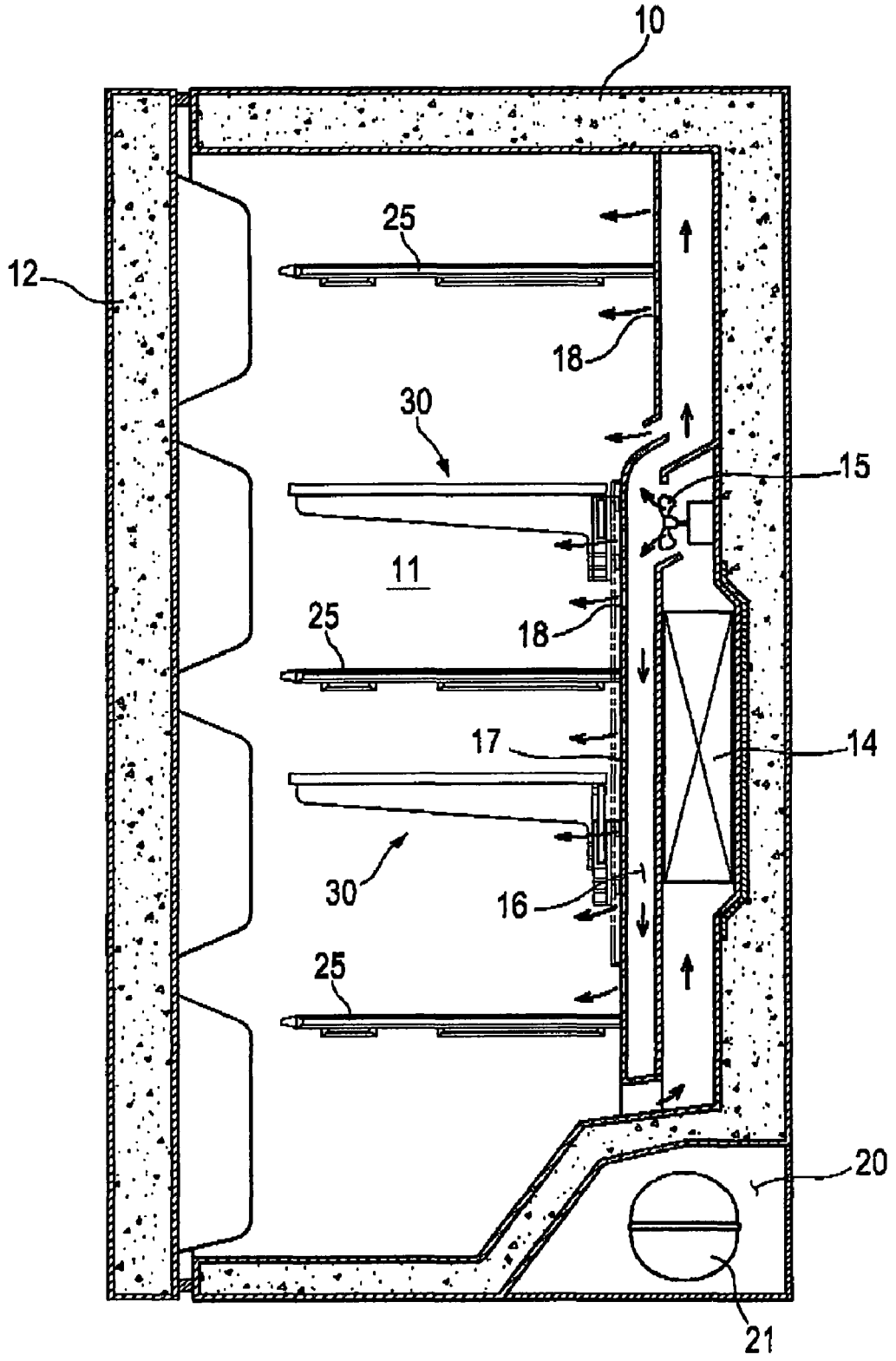
FIG. 1 is a sectional view illustrating a refrigerator adopting a variable shelf assembly according to an embodiment of the present invention.

Reference will now be made in detail to the embodiment of the present invention, an example of which is illustrated in the accompanying drawings, wherein like reference numerals refer to like elements throughout. The embodiment is described below to explain the present invention by referring to the figures.

As shown in FIG. 1, a refrigerator adopting a variable shelf assembly according to an embodiment of the present invention includes a main body 10 having a storage compartment 11, which is opened at the front thereof, defined therein and a door 12 to open and close the storage compartment 11.

At the inside rear of the storage compartment 11 is mounted an evaporator 14 to cool the storage compartment 11. Above the evaporator 14 is mounted a cool air circulation fan 15 to circulate air in the storage compartment 11. The evaporator 14 is adjacent to the rear wall of the main body 11. In front of the evaporator 14 is mounted an inside panel 17 to partition a space where the evaporator 14 is mounted from the storage compartment 11 and to define a cool air circulation channel 16.

In the inside panel 17 are formed a plurality of discharge holes 18 to dispersedly discharge cool air, guided through the cool air circulation channel 16, to the storage compartment 11. The cool air circulation fan 15 blows the air, having passed through the evaporator 14, such that the air in the storage compartment 11 is circulated through the evaporator 14.

At the bottom of the main body 10 is defined a machine compartment 20, which is partitioned from the storage compartment 11. In the machine compartment 20 are mounted a compressor 21, a condenser (not shown), and a refrigerant expansion device (not shown).

In the storage compartment 11 are mounted a plurality of shelves 25 and 30, which are vertically spaced apart from each other. The shelves 25 and 30 partition the interior of the storage compartment 11 into multiple stages to efficiently use the storage space. Some of the shelves are variable shelf assemblies 30 whose height can be changed if necessary, and the remaining shelves 25 are fixedly mounted in the storage compartment 11.

Figure 2:
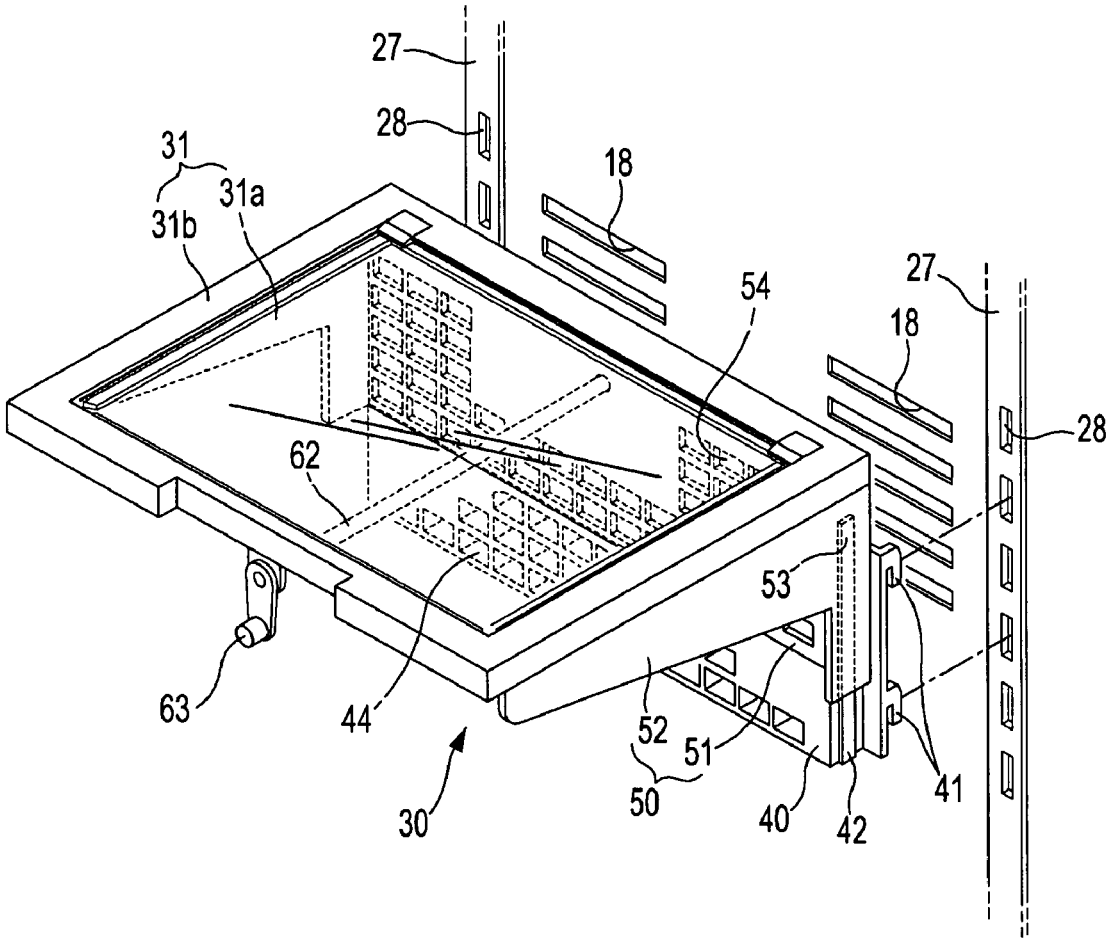
FIG. 2 is a perspective view illustrating a variable shelf assembly according to an embodiment of the present invention.
Figure 3:
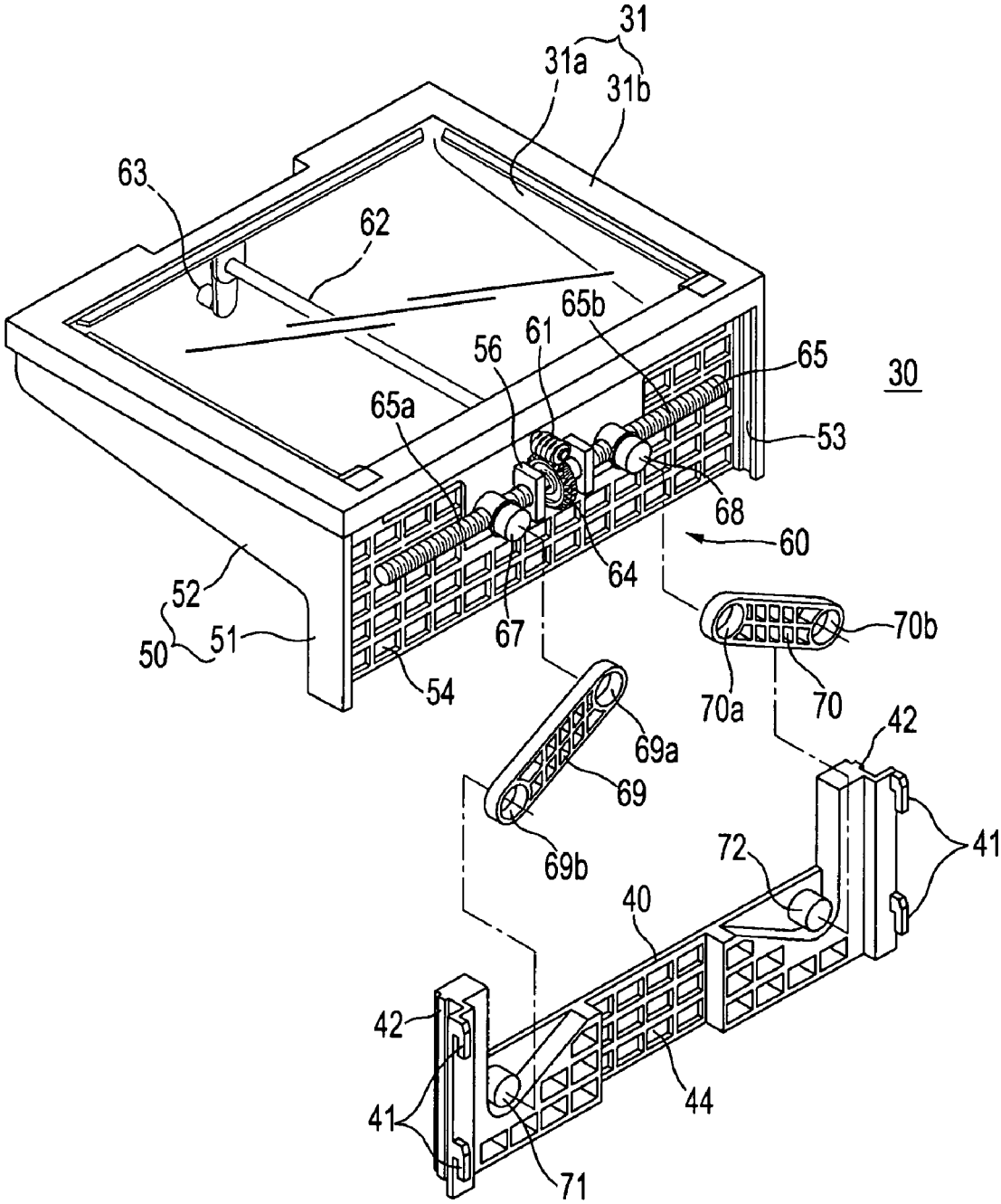
FIG. 3 is an exploded perspective view illustrating the structure of a lifting unit of the variable shelf assembly according to an embodiment of the present invention.

As shown in FIGS. 2 and 3, each variable shelf assembly 30, whose height can be changed, includes a mounting member 40 fixed to the rear wall of the storage compartment 11, a shelf support member 50 coupled to the mounting member 40 such that the shelf support member 50 is vertically movable, a shelf 31 mounted on the shelf support member 50, and a lifting unit 60 to lift the shelf support member 50.

As shown in FIG. 3, the mounting member 40 is formed in the shape of a panel having a width equivalent to that of the storage compartment 11. At opposite sides of the rear of the mounting member 40 are formed catching hooks 41 to fix the mounting member 40 to the rear wall of the storage compartment 11. As shown in FIG. 2, support frames 27, having a plurality of catching grooves 28, are mounted at opposite sides of the rear wall of the storage compartment 11 such that the mounting member 40 is fixed to the support frames 27. The catching grooves 28 of each support frame 27 are vertically spaced apart from each other. Consequently, the mounting member 40 is fixed to the support frames 27 by the engagement of the catching hooks 41 into the catching grooves 28. The engagement positions of the catching hooks 41 may be moved upward or downward to change the mounting position of the mounting member 40.

As shown in FIG. 3, the shelf support member 50 includes a lifting panel part 51 coupled to the mounting member 40 such that the lifting panel part 51 is vertically movable and support parts 52 extending from opposite sides of the lifting panel part 51 to support the shelf 31. The shelf support member 50 further includes first rails 53 formed at the opposite sides of the lifting panel part 51. The first rails 53 are coupled to second rails formed at the opposite sides of the mounting member 40 such that the first rails 53 are vertically movable. Specifically, the first rails 53 of the lifting panel part 51 are slidably coupled to the second rails 42 of the mounting member 40. The lifting panel part 51 may be integrally formed with the support parts 52. Alternatively, the lifting panel part 51 may be manufactured separately from the support parts 52, and then coupled to the support parts 52.

The shelf 31 includes a transparent reinforced glass 31*a* and a frame 31*b* to support the edge of the reinforced glass 31*a*. The shelf 31 is mounted on the support parts 52 of the shelf support member 50. Consequently, when the shelf support member 50 is vertically moved, the shelf 31 moves vertically.

The mounting member 40 and the lifting panel part 51 of the shelf support member 50 are provided with pluralities of cool air circulation holes 44 and 54, respectively. As a result, cool air, circulating in the storage compartment 11, passes through the cool air circulation holes 44 and 54, whereby the smooth circulation of the cool air in the storage compartment 11 is accomplished even when the mounting member 40 and the lifting panel part 51 are adjacent to the discharge holes 18 at the rear of the storage compartment 11. Consequently, the cool air is smoothly circulated even when the height of the lifting panel part 51 is changed through the adjustment of the height of the shelf.

As shown in FIG. 3, the lifting unit 60, which lifts the shelf support member 50, includes a driving gear 61, a driven gear 64, a screw shaft 65, first and second moving members 67 and 68, first and second rotary links 69 and 70, a connection rod 62, and a rotary grip 63.

The driving gear 61 is constructed in the form of a worm gear rotatably mounted to the rear center of the lifting panel part 51 of the shelf support member 50. The driving gear 61 is rotatably mounted below the shelf 31, and is connected to the connection rod 62, which extends lengthily in the forward-and-backward direction. The rotary grip 63 is mounted to the end of the connection rod 62 at the front of the shelf 31. Consequently, when a user rotates the rotary grip 63 in the forward direction or the reverse direction, the driving gear 61 rotates in the forward direction or the reverse direction.

The screw shaft 65 extends lengthily in the lateral direction while the screw shaft 65 is rotatably supported by a shaft support part 56 disposed at the rear of the lifting panel part 51. The driven gear 64 is mounted on the middle of the screw shaft 65 such that the driven gear 64 is rotated along with the screw shaft 65. The driven gear 64 is engaged with the worm-type driving gear 61. Consequently, as the driven gear 64 rotates by the rotation of the driving gear 61, the screw shaft 65 rotates.

The screw shaft 65 includes a left-handed screw part 65*a* and a right-handed screw part 65*b* disposed at opposite sides of the driven gear 64. The first moving member 67 is mounted to the left-handed screw part 65*a*, and the second moving member 68 is mounted to the right-handed screw part 65*b*. With the rotation of the screw shaft 65, therefore, the first moving member 67 and the second moving member 68 move in opposite directions along the screw shaft 65.

As shown in FIG. 3, the first rotary link 69 and the second rotary link 70 are constructed in the form of a bar having a predetermined length. At opposite ends of the first rotary link 69 and the second rotary link 70 are formed shaft coupling holes 69*a*, 69*b*, 70*a*, and 70*b*. In order to mount the first rotary link 69 and the second rotary link 70, a first support shaft 71 and a second support shaft 72 are mounted at opposite sides of the rear of the mounting member 40. The first rotary link 69 has one end rotatably connected to the first moving member 67 and the other end rotatably connected to the first support shaft 71. The second rotary link 70 has one end rotatably connected to the second moving member 68 and the other end rotatably connected to the second support shaft 72. For coupling, the first and second moving members 67 and 69 are constructed in the form of a cylinder that is inserted into the shaft coupling holes 69*a* and 70*a* of the first and second moving members 67 and 69.

Figure 4:
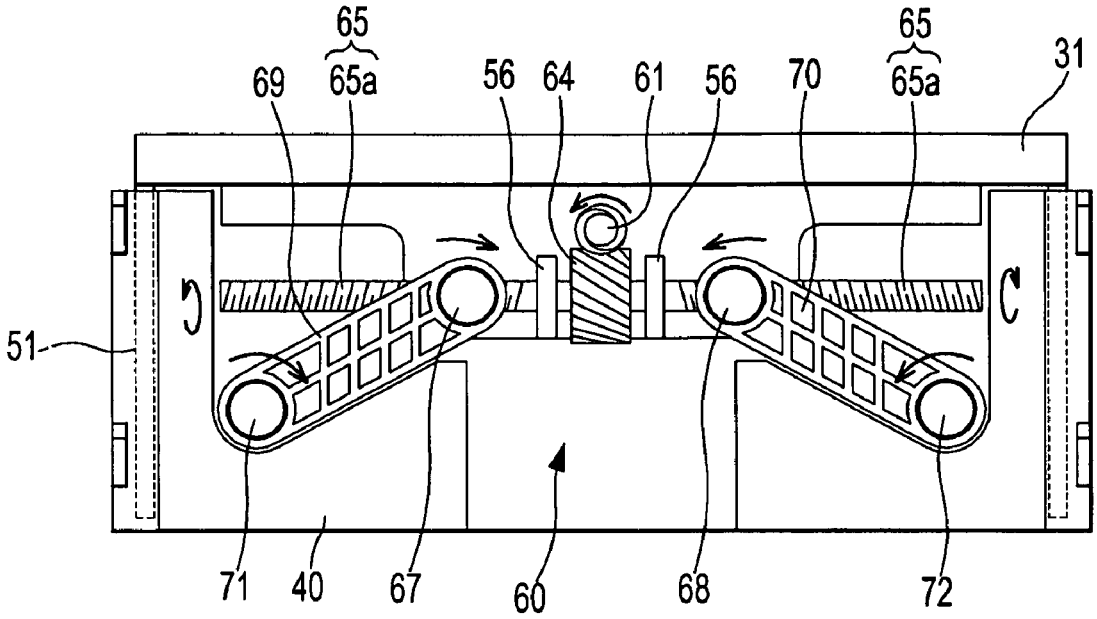
FIG. 4 is a view illustrating the operating principle of the lifting unit of the variable shelf assembly according to an embodiment of the present invention, with a shelf support member being lowered.

When the user rotates the rotary grip 63 in a first direction such that the screw shaft 65 moves in the first direction, as shown in FIG. 4, the first and second moving members 67 and 68 move toward the driven gear 64 (toward the middle). Consequently, the first and second moving members 67 and 68 rotate in opposite directions such that the upper parts of the first and second moving members 67 and 68 approach the driven gear 64, whereby the shelf support member 50 is lowered.

Figure 5:
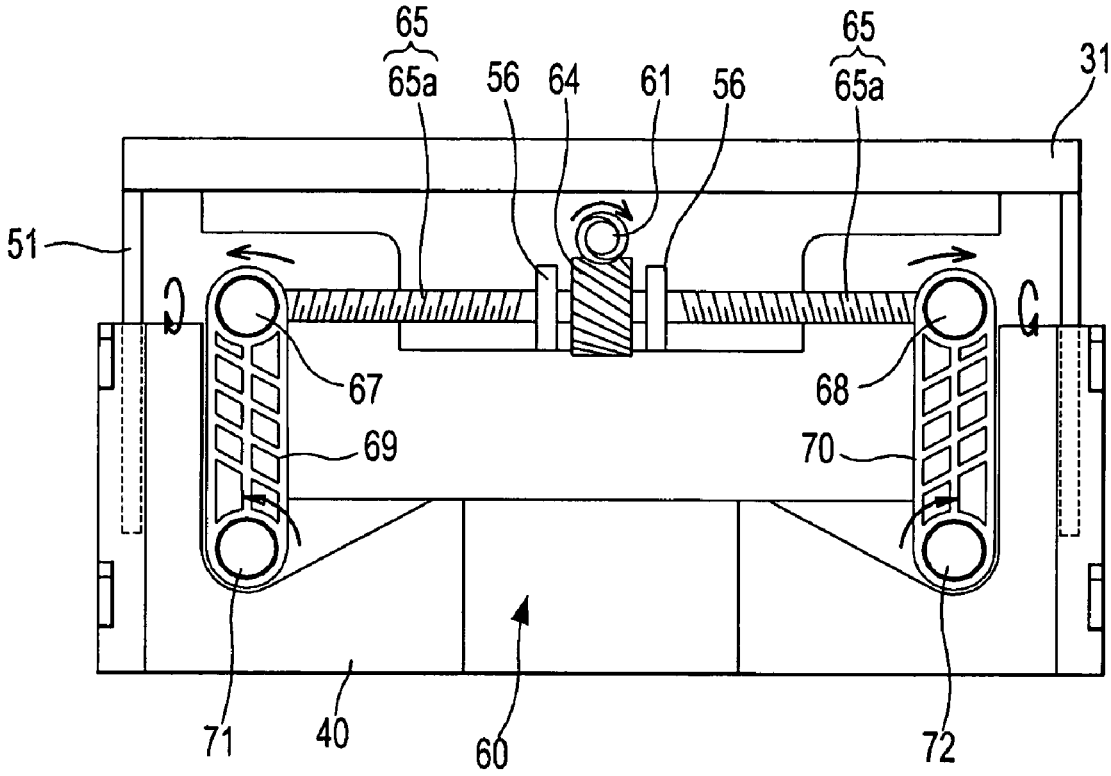
FIG. 5 is a view illustrating the operating principle of the lifting unit of the variable shelf assembly according to an embodiment of the present invention, with the shelf support member being raised.

On the other hand, when the user rotates the rotary grip 63 in a second direction such that the screw shaft 65 moves in the second direction, as shown in FIG. 5, the first and second moving members 67 and 68 move toward opposite ends of the screw shaft 65. Consequently, the first and second moving members 67 and 68 rotate in opposite directions such that the upper parts of the first and second moving members 67 and 68 approach the opposite ends of the screw shaft 65, whereby the shelf support member 50 rises.

As described above, the vertical movement of the shelf support member 50 is accomplished by the operation the screw shaft 65, the first and second moving members 67 and 68, and the first and second rotary links 69 and 70, which constitute the lifting unit 60 according to an embodiment of the present invention. Consequently, it is possible to simplify the structure of the lifting unit 60 according to the embodiment of the present invention as compared to that of the conventional lifting unit. Specifically, it is possible to simplify the structure of the lifting unit 60 according to an embodiment of the present invention as compared to the conventional lifting unit adopting the two spur gears, the two rack gears, and the gear bracket. Consequently, it is possible to simplify the manufacturing process thereof and to reduce the manufacturing costs thereof.

As apparent from the above description, the mounting member and the lifting panel part of the shelf support member are provided with pluralities of cool air circulation holes, respectively. Consequently, the smooth circulation of cool air in the storage compartment 11 is accomplished even when the mounting member and the lifting panel part are adjacent to the cool air discharge holes at the rear of the storage compartment. Particularly, the cool air is smoothly circulated even when the height of the lifting panel part 51 is changed through the adjustment of the height of the shelf.

Furthermore, the vertical movement of the shelf support member is accomplished by the operation the screw shaft, the first and second moving members, and the first and second rotary links, which constitute the present lifting unit. Consequently, it is possible to simplify the structure of the present lifting unit as compared to the conventional lifting unit adopting the two spur gears, the two rack gears, and the gear bracket, whereby it is possible to simplify the manufacturing process thereof and to reduce the manufacturing costs thereof.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A variable shelf assembly comprising:

a mounting member detachably mounted in a storage compartment of a refrigerator;

a shelf support member including a lifting panel part coupled to the mounting member such that the shelf support member is vertically movable;

a shelf mounted on the shelf support member;

a lifting unit to lift the shelf support member; and a panel defining a channel in the storage compartment to circulate cool air, wherein the mounting member or the lifting panel part of the shelf support member has a plurality of cool air discharge holes through which cool air circulating in the channel is discharged, and the lifting unit includes a driving gear mounted to the shelf support member, a driven gear rotated by the driving gear, a screw shaft coupled to the driven gear and rotatable supported by the shelf support member, at least one moving member coupled to the screw shaft and movable by the rotation of the screw shaft, and at least one rotary link having a first end rotatably coupled to the moving member and a second end rotatably coupled to the mounting member.

2. The variable shelf assembly according to claim 1, wherein:

the screw shaft includes a left-handed screw part and a right-handed screw part disposed at opposite sides of the driven gear, the moving member includes first and second moving members mounted to the left-handed screw part and the right-handed screw part, respectively, and movable in opposite directions by the rotation of the screw shaft, and the rotary link includes a first rotary link having a first end rotatably coupled to the first moving member and a second end rotatably coupled to a first position of the mounting member and a second rotary link having a first end rotatably coupled to the second moving member and a second end rotatably coupled to a second position of the mounting member.

3. The variable shelf assembly according to claim 1, wherein the lifting unit further includes a rotary grip to rotate the driving gear and a connection rod to interconnect the rotary grip and the driving gear.

4. The variable shelf assembly according to claim 1, further comprising a support frame having a plurality of grooves, wherein the mounting member comprises a plurality of hooks, and the hooks are received in respective ones of the grooves.

5. The variable shelf assembly according to claim 4, wherein the grooves comprise:

a first plurality of grooves disposed vertically relative to each other in a first column, and a second plurality of grooves disposed vertically relative to each other in a second column, wherein the discharge holes are between the first plurality of grooves and the second plurality of grooves.

6. A variable shelf assembly comprising:

a mounting member mounted to an object to be supported;

a shelf support member including a lifting panel part coupled to the mounting member such that the shelf support member is vertically movable;

a support frame to receive the shelf support member;

a shelf mounted on the shelf support member;

a lifting unit to lift the shelf support member; and a panel defining a channel to circulate cool air, wherein the lifting unit includes a driving gear mounted to the shelf support member, a driven gear rotatable by the driving gear, a screw shaft coupled to the driven gear and rotatably supported by the shelf support member, at least one moving member coupled to the screw shaft and movable by the rotation of the screw shaft, and at least one rotary link having a first end rotatably coupled to the moving member and a second end rotatably coupled to the mounting member, and the mounting member or the lifting panel part of the shelf support member has a plurality of cool air discharge holes through which cool air circulating in the channel is discharged.

7. The variable shelf assembly according to claim 6, wherein the screw shaft includes a left-handed screw part and a right-handed screw part disposed at opposite sides of the driven gear, the moving member includes first and second moving members mounted to the left-handed screw part and the right-handed screw part, respectively, and movable in opposite directions by the rotation of the screw shaft, and the rotary link includes a first rotary link having a first end rotatably coupled to the first moving member and a second end rotatably coupled to a first position of the mounting member and a second rotary link having a first end rotatably coupled to the second moving member and a second end rotatably coupled to a second position of the mounting member.

8. The variable shelf assembly according to claim 6, wherein the lifting unit further includes a rotary grip to rotate the driving gear and a connection rod to interconnect the rotary grip and the driving gear.

9. A refrigerator comprising:

a main body having a storage compartment defined therein;

and a plurality of shelves disposed in the storage compartment;

at least one shelf assembly mounted in the storage compartment, wherein the shelf assembly includes:

a mounting member mounted in the storage compartment, a shelf support member including a lifting panel part coupled to the mounting member such that the shelf support member is vertically movable, one of the shelves being mounted on the shelf support member, a support frame to receive the shelf support member, a lifting unit to lift the shelf support member, the lifting unit comprising a rotary grip, and a panel defining a channel in the storage compartment to circulate cool air, wherein the mounting member and/or the lifting panel part of the shelf support member has a plurality of cool air discharge holes through which cool air circulating in the storage compartment is discharged, wherein the rotary grip is installed at the shelf to drive the lifting unit such that the distance between the one of the shelves and the other shelves is adjusted, and wherein the lifting unit includes a driving gear mounted to the shelf support member, a driven gear rotatable by the driving gear, a screw shaft coupled to the driven gear and rotatably supported by the shelf support member, at least one moving member coupled to the screw shaft and movable by the rotation of the screw shaft, and at least one rotary link having a first end rotatably coupled to the moving member and a second end rotatably coupled to the mounting member.

10. The refrigerator according to claim 9, wherein the screw shaft includes a left-handed screw part and a right-handed screw part disposed at opposite sides of the driven gear, the moving member includes first and second moving members mounted to the left-handed screw part and the right-handed screw part, respectively, and movable in opposite directions by the rotation of the screw shaft, and the rotary link includes a first rotary link having one end rotatably coupled to the first moving member and the other end rotatably coupled to a first position of the mounting member and a second rotary link having a first end rotatably coupled to the second moving member and a second end rotatably coupled to a second position of the mounting member.

11. The refrigerator according to claim 9, wherein the lifting unit further includes the rotary grip to rotate the driving gear and a connection rod to interconnect the rotary grip and the driving gear.

12. A refrigerator comprising:

a main body defining a storage compartment therein; and a plurality of shelves disposed in the storage compartment at least one shelf assembly mounted in the storage compartment, wherein the shelf assembly includes:

a mounting member mounted in the storage compartment, a shelf support member including a lifting panel part coupled to the mounting member such that the shelf support member is vertically movable, one of the shelves being mounted on the shelf support member, and a lifting unit to lift the shelf support member, the lifting unit disposed at the lifting panel part and comprising a rotary grip and wherein the lifting unit includes:

a driving gear mounted to the shelf support member, a driven gear rotatable by the driving gear, a screw shaft coupled to the driven gear and rotatably supported by the shelf support member, at least one moving member coupled to the screw shaft and movable by the rotation of the screw shaft, and at least one rotary link having a first end rotatably coupled to the moving member and a second end rotatably coupled to the mounting member, the rotary grip being installed at the one of the shelves to drive the lifting unit such that the distance between the shelf and other shelves is adjusted, wherein the mounting member or the lifting panel part of the shelf support member has a plurality of cool air discharge holes through which cool air is discharged.

13. The refrigerator according to claim 12, wherein the screw shaft includes a left-handed screw part and a right-handed screw part disposed at opposite sides of the driven gear, the moving member includes first and second moving members mounted to the left-handed screw part and the right-handed screw part, respectively, and movable in opposite directions by the rotation of the screw shaft, and the rotary link includes a first rotary link having a first end rotatably coupled to the first moving member and a second end rotatably coupled to a first position of the mounting member and a second rotary link having a first end rotatably coupled to the second moving member and a second end rotatably coupled to a second position of the mounting member.

14. The refrigerator according to claim 12, wherein the lifting unit further includes the rotary grip to rotate the driving gear and a connection rod to interconnect the rotary grip and the driving gear.

* * * * *

UNITED STATES PATENT AND TRADEMARK OFFICE

CERTIFICATE OF CORRECTION

PATENT NO. : 8,172,347 B2
APPLICATION NO. : 12/003769
DATED : May 8, 2012
INVENTOR(S) : Jae Hoon Lim et al.

It is certified that error appears in the above-identified patent and that said Letters Patent is hereby corrected as shown below:

Column 7, Line 8 (Approx.), In Claim 1, delete “rotatable” and insert -- rotatably --, therefor.

Signed and Sealed this
Seventeenth Day of July, 2012

David J. Kappos

David J. Kappos
*Director of the United States Patent and Trademark Office*